US010662630B2

(12) United States Patent
Tucker

(10) Patent No.: US 10,662,630 B2
(45) Date of Patent: May 26, 2020

(54) INFRASONIC SMART HOME SECURITY SYSTEM

(71) Applicant: Mitchell Tucker, Ocala, FL (US)

(72) Inventor: Mitchell Tucker, Ocala, FL (US)

( * ) Notice: Subject to any disclaimer, the term of this patent is extended or adjusted under 35 U.S.C. 154(b) by 0 days.

(21) Appl. No.: 16/299,219

(22) Filed: Mar. 12, 2019

(65) Prior Publication Data

US 2019/0244496 A1 Aug. 8, 2019

Related U.S. Application Data

(60) Provisional application No. 62/709,820, filed on Feb. 2, 2018.

(51) Int. Cl.

| | |
|---|---|
| ***E03C 1/262*** | (2006.01) |
| ***E03C 1/22*** | (2006.01) |
| ***G08B 13/16*** | (2006.01) |
| ***G08B 13/196*** | (2006.01) |
| ***G08B 21/18*** | (2006.01) |

(52) U.S. Cl.

CPC ..... *E03C 1/262* (2013.01); *E03C 1/22* (2013.01); *G08B 13/1681* (2013.01); *G08B 13/196* (2013.01); *G08B 21/182* (2013.01)

(58) Field of Classification Search

CPC combination set(s) only.
See application file for complete search history.

(56) References Cited

U.S. PATENT DOCUMENTS 5,192,931 A * 3/1993 Smith ..... G08B 13/04 340/541
5,793,286 A * 8/1998 Greene ..... G08B 29/183 340/522
6,570,500 B1 * 5/2003 Pieper ..... G08B 13/1681 340/541

* cited by examiner

*Primary Examiner* — Travis R Hunnings
(74) *Attorney, Agent, or Firm* — The Rapacke Law Group, P.A.

(57) ABSTRACT

A network-connected security system comprising an infrasonic detection system including a transducer to sense infrasonic frequency variations in an environment and produce an output signal corresponding to the plurality of infrasonic frequency variations is provided. A processor is configured to compare, via an intrusion detection, the plurality of infrasonic frequency variations with a threshold value stored in a memory and determine if the threshold value is exceeded. If exceeded, an alert module transmits an output signal to an alarm system. A controller is located in the environment and in communication with the infrasonic detection system and a plurality of network-connected devices. The controller has a user interface to input control settings of the network-connected devices. A computing device is in communication with the controller to permit remote control of the infrasonic detection system, the alarm system, and the network-connected devices via an application system displayed on a display of the computing device.

20 Claims, 5 Drawing Sheets

INFRASONIC SMART HOME SECURITY SYSTEM

TECHNICAL FIELD

The embodiments generally relate to smart home systems, and more specifically, relate to smart home security systems which utilize infrasonic technology.

BACKGROUND

Many homes and buildings have begun incorporating smart home devices which monitor security, energy consumption, home and yard maintenance, environmental conditions, fires, floods, and pollutants.

Conventional security systems include an intrusion detection system having a controller and a variety of sensors positioned in the interior and/or the exterior of a building and the surrounding environment. Their integration into smart home systems allows for the programming of the intrusion detection system to monitor particular zones of an environment. While useful in homes, these systems are typically not operational unless no entry or exit from the premise is permitted, leaving the home vulnerable when occupants are entering and exiting the home regularly in a permitted manner. Further, users may forget to activate the security system leaving the premise inadvertently unsecured.

A setback of many intrusion detection systems is the use of door and window alarms which detect the opening and closing of the entry point. It has been shown that many intruders resort to breaking a window or screen to gain access to the premise and effectively bypass the intrusion detection system mounted at the threshold. Infrasonic technology has been used to monitor an area by scanning infrasonic sound waves below 20 hertz (HZ). This allows for the activation of the security system while filtering non-threatening events such as permitted occupants entering and exiting the premise.

SUMMARY OF THE INVENTION

This summary is provided to introduce a variety of concepts in a simplified form that is further disclosed in the detailed description of the invention. This summary is not intended to identify key or essential inventive concepts of the claimed subject matter, nor is it intended for determining the scope of the claimed subject matter.

The embodiments presented herein provide for a network-connected security system comprising an infrasonic detection system including a transducer to sense infrasonic frequency variations in an environment and produce an output signal corresponding to the plurality of infrasonic frequency variations. A processor is configured to compare, via an intrusion detection, the plurality of infrasonic frequency variations with a threshold value stored in a memory and determine if the threshold value is exceeded. If exceeded, an alert module transmits an output signal to an alarm system. A controller is located in the environment and in communication with the infrasonic detection system and a plurality of network-connected devices. The controller has a user interface to input control settings of the network-connected devices. A computing device is in communication with the controller to permit remote control of the infrasonic detection system, the alarm system, and the network-connected devices via an application system displayed on a display of the computing device.

In one aspect, the alarm system contacts one or more third-party users via a communications module.

In one aspect, the plurality of network connected devices may include one or more thermostats, one or more occupancy sensors, one or more entryway devices, one or more hazard detection devices, one or more electrical components, one or more motion sensors, one or more cameras, and one or more speakers.

In one aspect, an event report generator is configured to create a report of an event defined by at least one of a plurality of infrasonic frequency variations. The event may also be defined by a signal received by the plurality of network-connected devices.

In one aspect, the event report is comprised of one or more images received from the one or more cameras. The images may be still images or video images. Event reports may also be stored in the memory.

In one aspect, an authentication module is in operable communication with the processor to provide authorization to persons in the environment via security input signals received from the plurality of network-connected devices.

In one aspect, the alert is shown on a display of the computing device as a report of an event. The report is generated by an event report generator in operable communication with the processor.

In one aspect, a communication module is in operable communication with the processor to transmit an audio signal to the speakers.

In one aspect, the memory stores a plurality of third-party users contact information and a plurality of user contact information. The communication module transmits the alert to the third-party users and/or the users based on predetermined user preferences.

In one aspect, the alert is comprised of a visual, an audible, or a tactile alert communicated to the environment, to the plurality of third-party users, to the plurality of users.

In another aspect, a method for detecting an infrasonic frequency to analyze the security of an environment is disclosed. A processor compares a plurality of infrasonic frequency variations with a pre-determined threshold value stored in a memory and determines if the threshold value is exceeded. The infrasonic frequency variations are detected via an infrasonic detection system. If a threshold value is exceeded, an output signal is then transmitted to an alarm system via an alert module in operable communication with the processor. The alarm system is configured to broadcast an alarm in response to the output signal. The alert module determines an alarm protocol in response to the output signal and executing the alarm protocol to produce the alert and transmits the alert to a computing device.

BRIEF DESCRIPTION OF THE DRAWINGS

A complete understanding of the present invention and the advantages and features thereof will be more readily understood by reference to the following detailed description when considered in conjunction with the accompanying drawings wherein.

DETAILED DESCRIPTION

Figure 1:
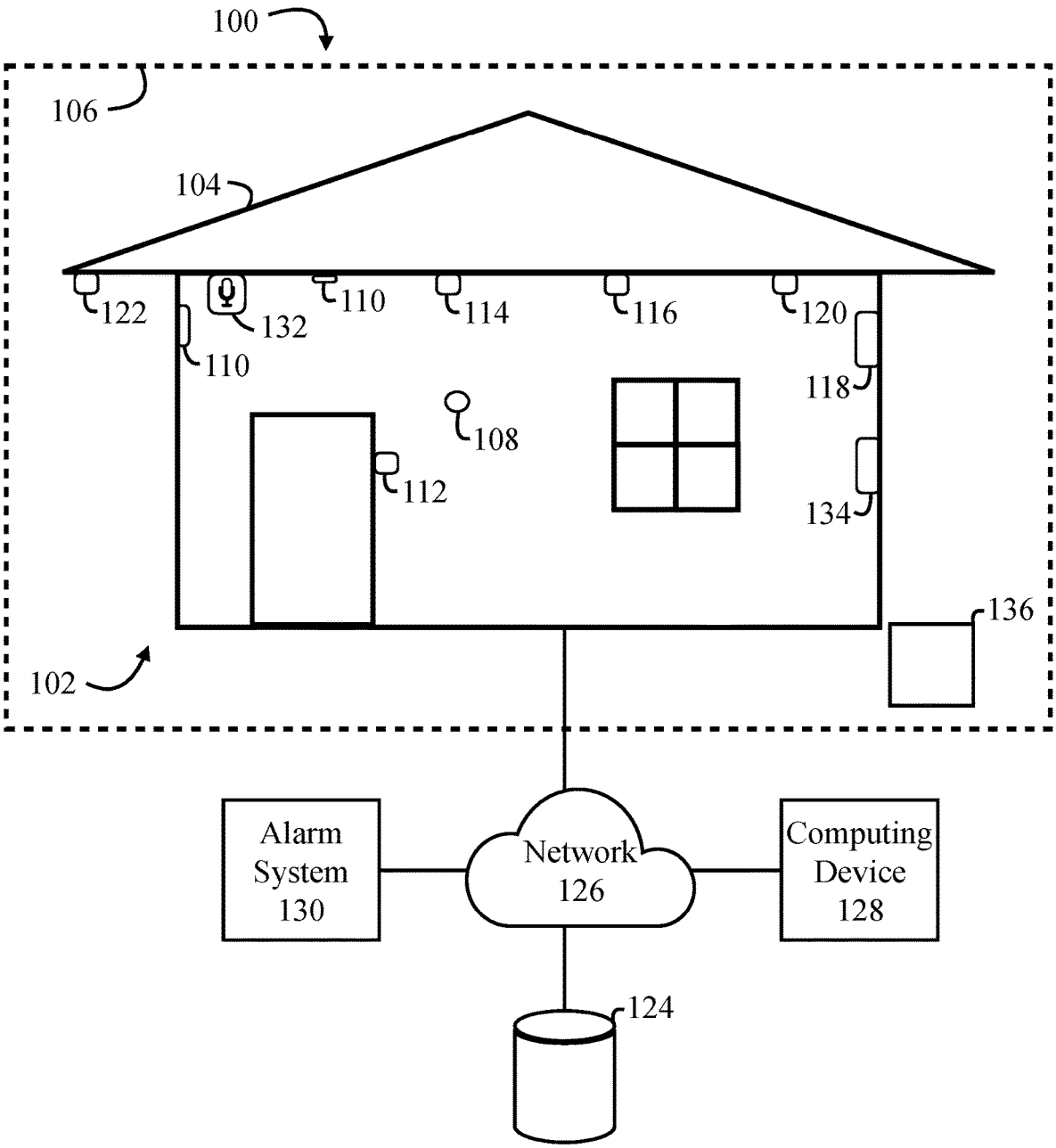
FIG. 1 illustrates a schematic of an infrasonic smart home environment having a smart home security system, according to some embodiments.

The specific details of the single embodiment or variety of embodiments described herein are to the described system and methods of use. Any specific details of the embodiments are used for demonstration purposes only and not unnecessary limitations or inferences are to be understood therefrom.

Before describing in detail exemplary embodiments, it is noted that the embodiments reside primarily in combinations of components and procedures related to the system and method. Accordingly, the system components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

As used herein, relational terms, such as "first" and "second" and the like, may be used solely to distinguish one entity or element from another entity or element without necessarily requiring or implying any physical or logical relationship or order between such entities or elements.

As used herein, the term "environment" may refer to a home, residential or commercial building, an outdoor region, or any premise wherein the security system (described below) is located and within which events (both permitted and unpermitted) can be detected and monitored.

As used herein, the term "users" can include permitted occupants of the environment, security personnel, property owners or property managers, or others who have access to the security system.

The infrasonic smart home security system described in the various embodiments herein includes an infrasonic sensor which detects variations in infrasonic frequency within an environment, for example, in a building or room. Infrasonic frequency may be defined as sound with a frequency too low to be detected by the human ear and includes sounds from the lower limit of human hearing, from about 20 Hz down to 0.001 Hz. The infrasonic frequency is detected using a transducer such as a microphone, which is then amplified. Certain events, including breakage or forced opening of a window or door, results in a change infrasonic frequency detectable by the transducer. If the change in infrasonic frequency is over a predetermined threshold, an alarm or alert system may be activated.

FIG. 1 illustrates a schematic of a security system 100 located in an environment 102 within which one or more of the devices, methods, systems, services, and/or computer program products described further herein may be applicable. The environment 102 may include a structure 104, which can include, for example, a house, office building, garage, mobile home, or vehicle. The environment 102 can also include a premise 106 outside of the structure 104 which may be monitored as well.

In some embodiments, the structure 104 can include a plurality of predefined zones such as rooms separated by walls, ceilings, and floors whereon the various devices of the security system 100 can be mounted.

In some embodiments, the security system 100 includes a plurality of devices, including intelligent, multi-sensing, network-connected devices, that can integrate seamlessly with each other and/or with a central server or a cloud-computing system to provide any of a variety of useful home security and/or smart home objectives. The security system 100 may include one or more network-connected thermostats 108, one or more network-connected occupancy/vacancy sensors 110, and one or more network-connected entryway devices 112. The smart entryway devices 112 can be attached to any window, door, entryway to detect when a window, door, or other entry point is opened, broken, or otherwise breached. According to embodiments, the smart thermostat 108 detects ambient climate characteristics (e.g., temperature and/or humidity) and may control an HVAC system accordingly. The smart occupancy sensors 110 may detect the presence of persons or animals within the environment 102. A hazard detection devices 114 may monitor hazardous substances in the environment or a substance or condition indicative of a hazardous substance (e.g., smoke, fire, or carbon monoxide). The smart entryway device 112 may control doorbell functionality, detect a person's approach to or departure from a location (e.g., an outer door), and announce a person's approach or departure via audio or visual means, or control settings on the security system 100 (e.g., to activate or deactivate a security system when occupants ingress and egress the environment 102).

In some embodiments, the security system 100 can include one or more network-connected electrical components 116 which can include network-connected electrical switches and network-connected wall plug interfaces. The network-connected electrical components 116 may detect ambient light levels in the environment 102, detect room occupancy states, and control power to the interior and exterior lights of the structure 104. Other network-connected electrical components 116 can include ceiling fans, HVAC systems, water heaters, and other common household devices which draw electrical power.

The security system 100 includes an infrasonic detection system 118 located in the environment 102 to detect changes in infrasonic frequencies. The infrasonic detection system 118 is useful for monitoring points of entry such as doors and windows which may be forcibly entered or broken by an intruder. The infrasonic detection system 118 may filter noise from events not considered threatening while activating an alarm for events considered threatening.

The security system 100 may also include a network-connected motion sensor 120 which transmits an alert signal once movement is detected in the environment 102. Further, in some embodiments, a camera 122 capable of capturing images of the environment 102 may be provided. Electronic images may be captured and stored on a remote storage system 124 such as a cloud-based storage system accessed via a network 126 for future viewing on a computing device 128.

In some embodiments, the security system 100 includes one or more network-connected alarm systems 130. Any suitable alarm system may be used in the present embodiments. Preferably, the alarm means will comprise an audible signal transmitted to the environment 102. Further, the alarm system 130 will preferably be in communication with the network 126 to notify a plurality of persons or services stored in a contacts list in the remote storage system 124. For example, the remote storage system 124 may include contact information for the police, emergency services, homeowner, or other trusted person who is designated as an emergency contact in the event of defined emergency.

The security system 100 may further include one or more network-connected speakers 132 capable of producing audible tones and/or audible spoken words that are intended to be heard by a person (whether a permitted occupant or an intruder) within the environment 102. The content of the audio communications may be stored on the remote storage system 124 or transmitted via the network to be broadcast by the speakers 132.

In some embodiments, the security system 100 is controlled by a network-connected controller 134 located in the environment 102. The network-connected controller 134 is in operable communication with each security device within the environment 102 including the thermostats 108, occupancy sensors 110, entryway device 112, hazard detection devices 114, electrical components 116, infrasonic detection systems 118, motion sensors 120, cameras, 122, remote storage systems 124, computing devices 128, alarms 130, and speakers 132 (collectively "devices") via the network 126.

In some embodiments, the infrasonic detection system 118 is integrated with the controller 134. It is contemplated that the controller 134 is comprised of one or more of the devices shown and described in FIG. 1.

In some embodiments, the controller 134 is comprised of a power source, such as a battery, which permits the operation of the controller 134 during a power outage. One or more backup batteries may be provided.

Figure 2:
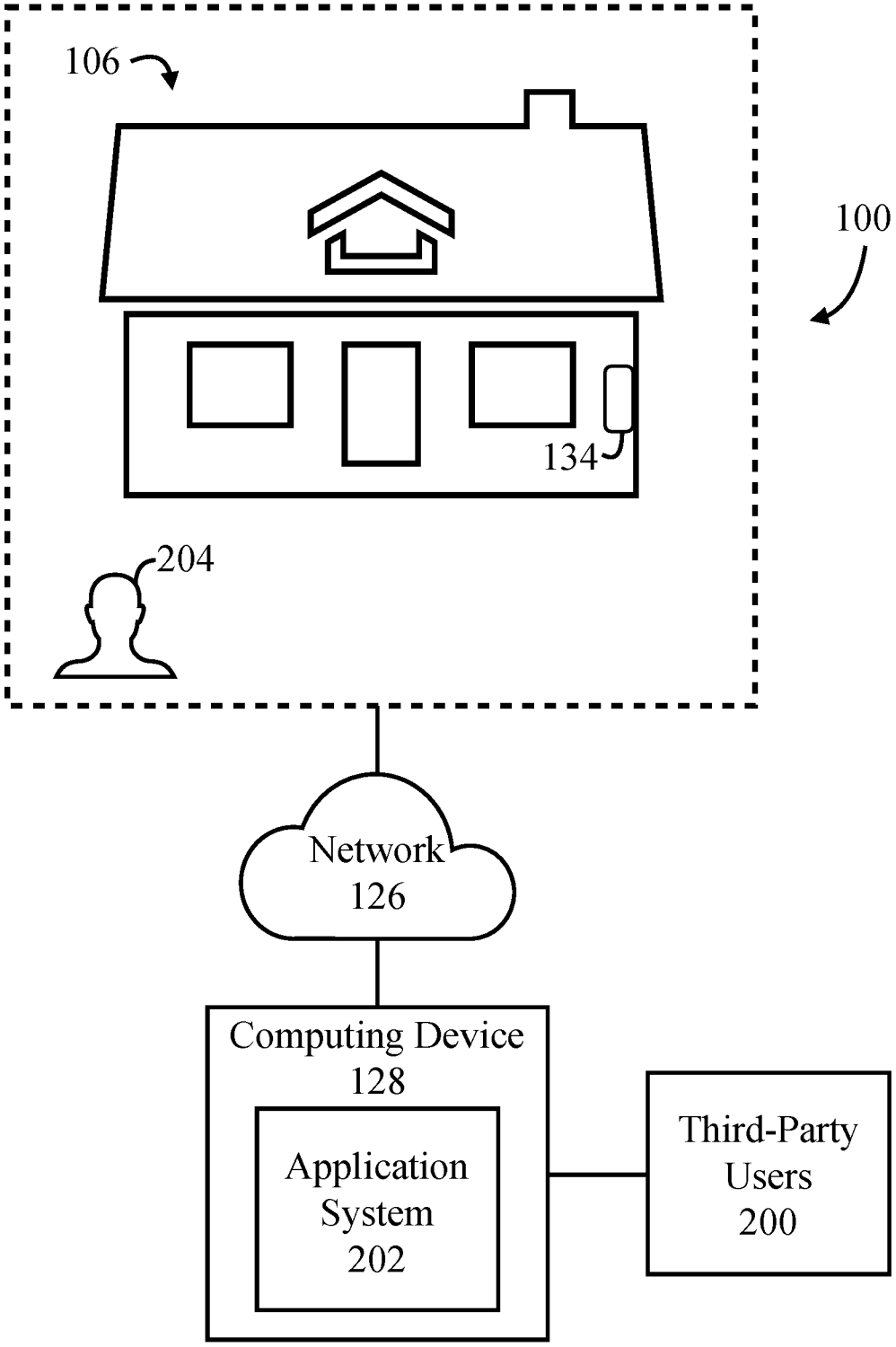
FIG. 2 illustrates a schematic of the infrasonic smart home security system, according to some embodiments.

FIG. 2 illustrates a communications network schematic for the security system 100. The controller 134 is in operable communication with the network connected device (as described in FIG. 1) to monitor the environment 102. A user 204 receives notifications of alerts on the one or more computing devices 128 from the controller 134 via the network 126. A plurality of third-party users 200 may also receive notifications via the network. The third-party users 200 can include emergency services, law enforcement, maintenance personnel, and likewise persons or entities in communication with the security system.

The computing device 126 may be associated with an authorized user 204 of the security system 100. An application system 206 may be implemented on the computing device 126 to provide various functionalities to the user 204. Further, the application system 206 may be implemented on the controller 134 providing functionalities thereto.

Figure 3:
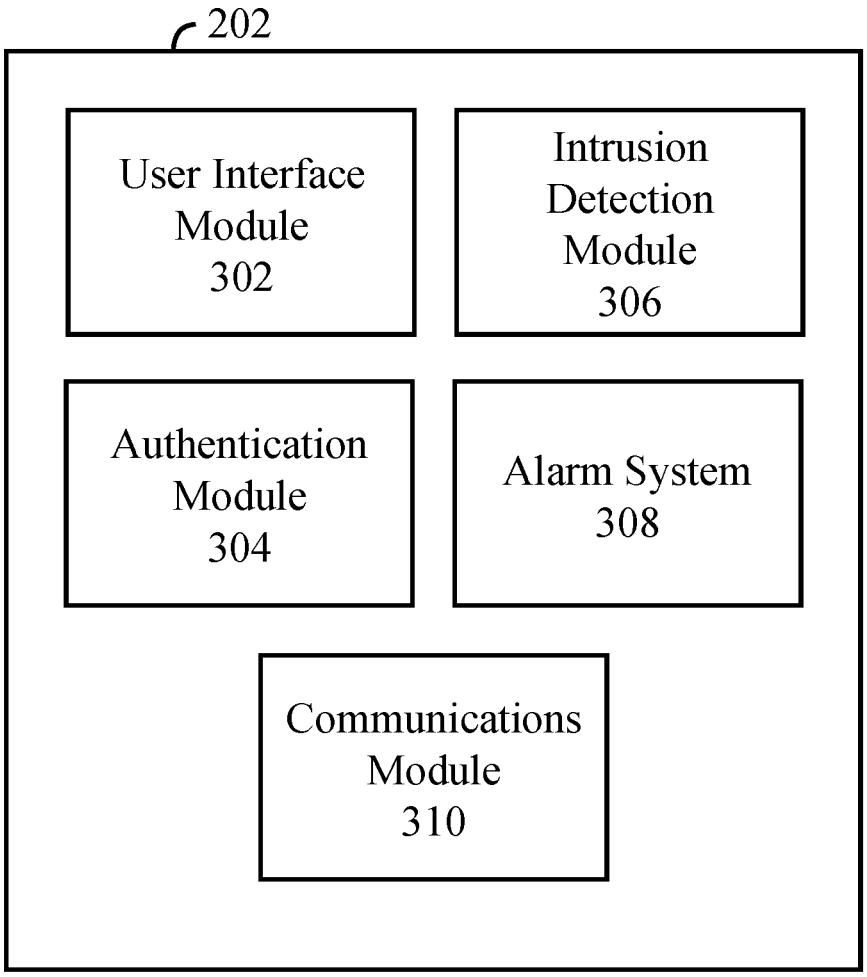
FIG. 3 illustrates a block diagram of the infrasonic smart home security system and integrated smart home sensor systems, according to some embodiments.

FIG. 3 illustrates a block diagram of the application system 206 in communication with one or more processors. The application system 206 may include a user interface engine 302 provided by the display of the computing device. The user interface module 302 may present selectable options to the user 204 including user preferences for the security system. An authentication module 304 receives input from the devices and authenticates users within the environment that can engage with the security system such as by arming or disarming an alarm, change user settings, change device settings, as well as gain access to the environment points of entry. An intrusion detection module 306 is in communication with the devices, including the infrasonic detection system. The intrusion detection module 306 receives an input signal from the devices and determines if a threshold value for the signal has been reached. For example, the infrasonic detection system detects infrasonic wavelengths for a period of time. The infrasonic wavelength values and period of time for which those wavelength values are sensed are transmitted to the intrusion detection module 306 to determine if a threshold is reached in which an intrusion event is likely. If the threshold is reached, the intrusion detection module 306 transmits an output signal to an alert module 308 configured to determine a suitable alert signal to be sent to the alarm system. A communications module 310 may also receive the alert signal and determine an appropriate third-party user to contact, in addition to contact one or more authorized users of the security system.

In some embodiments, the application system 206 can include a report generator configured to generate a report of an event. The application system 206 receives the output signal from the alarm system. Data may be received from the devices (such as the camera and infrasonic detection system) and aggregated into a viewable report displayed on the computing device. The report can include images, such as video and still images of the event. For example, the report can include images of an intruder. The infrasonic detection system may detect the intruder by detecting an infrasonic frequency variation which exceeds a threshold value stored in the memory. The camera may capture images of the intruder and send the image data to the report generator.

Figure 4:
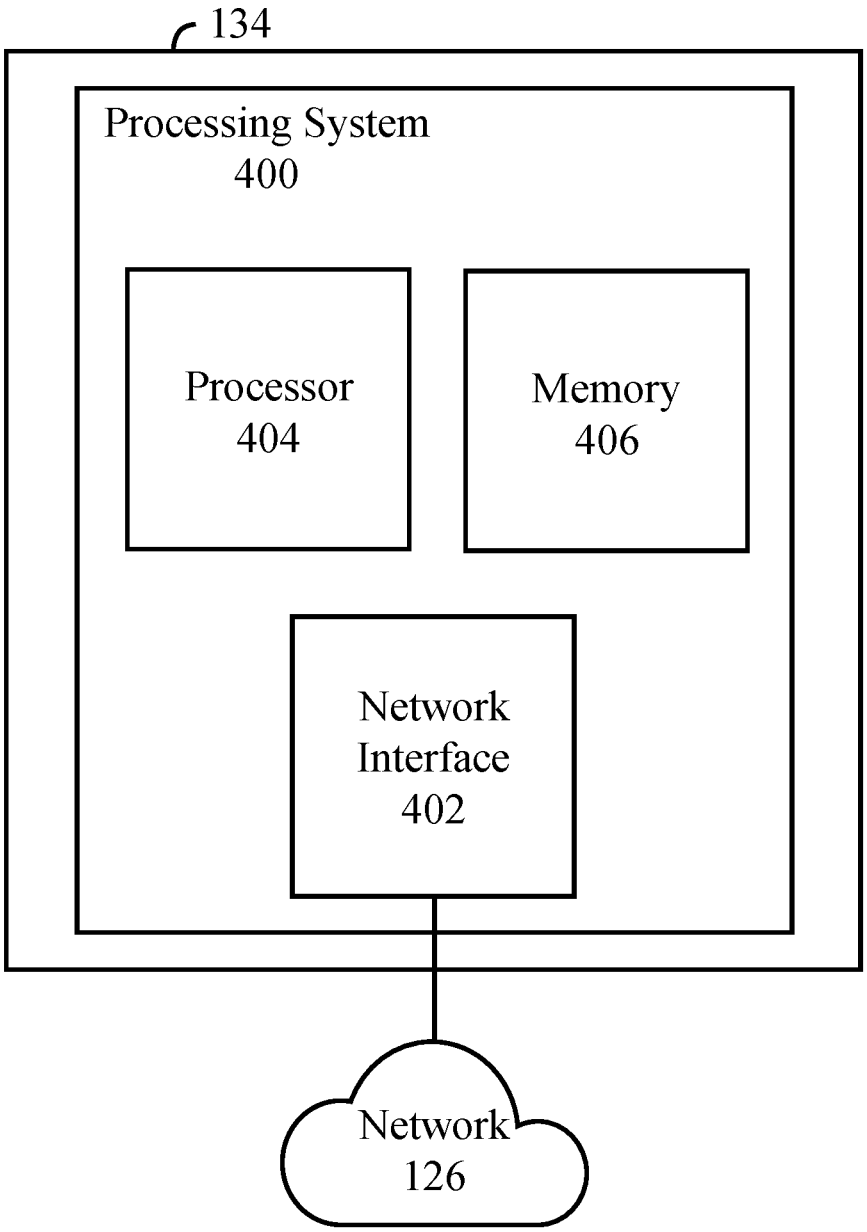
FIG. 4 illustrates a block diagram of the controller components, according to some embodiments.

FIG. 4 illustrates a block diagram of the controller 134 which can include at least one network interface 402 through which the controller 134 may communicate with external components of the security system either directly or via the network 126. Controller 100 further includes a processing system 400 programmed or otherwise arranged to implement the system as described hereinabove. Processing system 400 may include one or more processors 404, and a memory module 406. The processing system 400 is coupled to the network interface 402 to enable the processing system 400 to communicate with the devices and computing devices of the security system.

Figure 5:
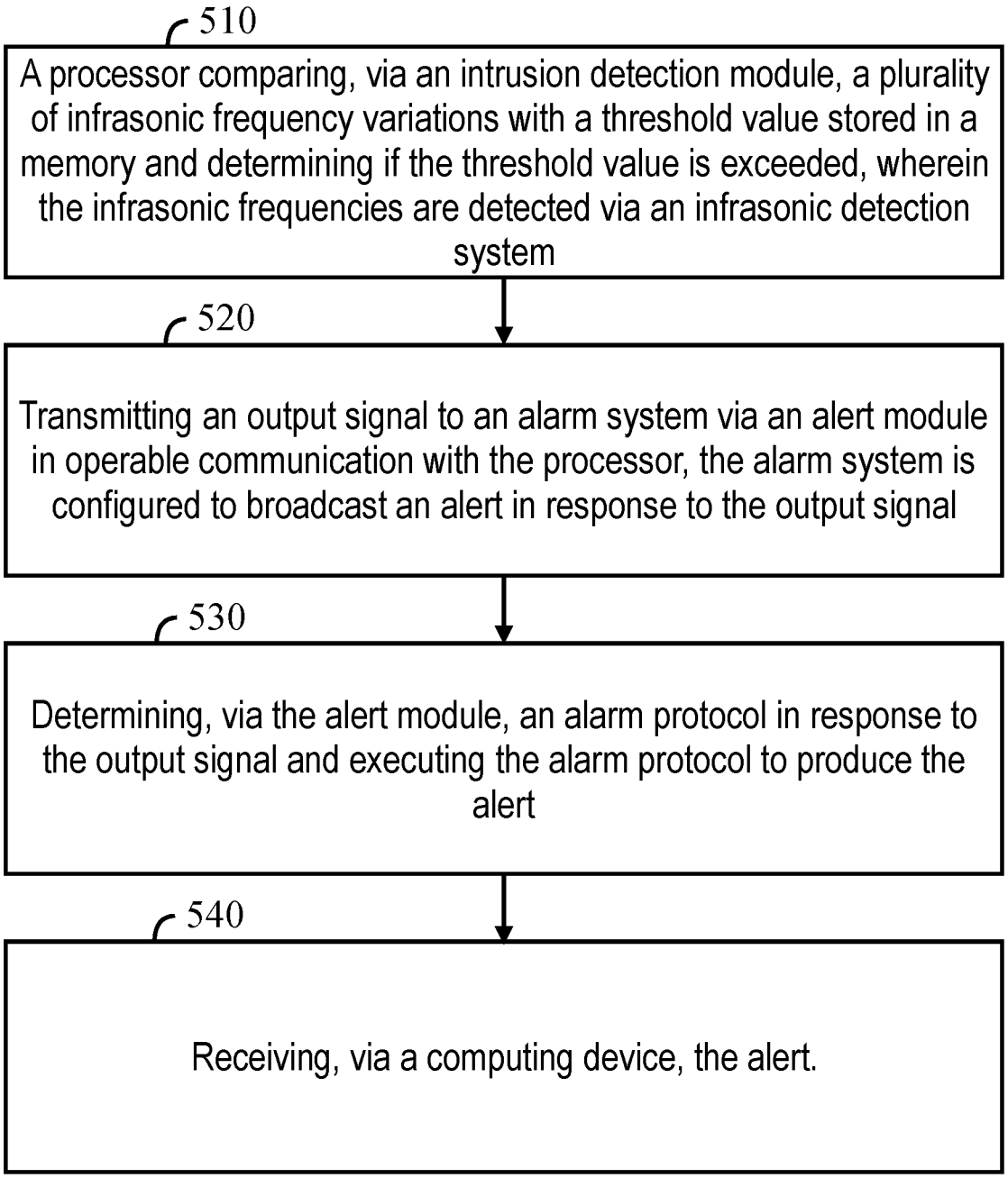
FIG. 5 illustrates a flowchart for a method for detecting an infrasonic frequency variation and transmitting an alert to a computing device, according to some embodiments.

FIG. 5 illustrates a flowchart of a method for detecting variations in infrasonic frequencies and transmitting an alert in response to the variation in the infrasonic frequencies detected in the environment. In step 510 the processor compares a plurality of infrasonic frequency variation detected by the infrasonic detection system with a plurality of threshold values stored in the memory. The threshold values may define infrasonic frequencies associated with an event which indicates a security risk. In step 520, an output signal is transmitted to an alarm system via an alert module in communication with the processor. The alarm system broadcasts an alert in response to the output signal which follows the determination of an infrasonic frequency threshold being exceeded. In step 530, the alert module determines an alarm protocol in response to the output signal which produces an appropriate alert. In step 540, the alert is then received by one or more computing devices in communication with users of the system.

In some embodiments, an alarm protocol can include a plurality of alerts sent to the devices in the environment, as well as alerts sent to the computing devices of the authorized user 204 and any third-party user 200 in communication with the network.

In some embodiments, a computing device is in wireless communication via a network. A network sever sends and receives data stored to and from a database. The network may be the Internet, a cellular network, a wired network, a wireless network, a cloud computing network, or other conventional network technology recognized in the art. It should be understood that, in practice, there will be plural and likely a large number of computing devices and provider computing devices connected to the network. The network server may be a unitary device but would preferably be implemented as a server farm or a distributed computing system to handle large capacities of virtual content stored in the database and the many simultaneous connections with computing devices. Further examples of communication networks include a local area. network ("LAN"), a wide area network ("WAN"), an inter-network (e.g., the Internet), and peer-to-peer networks (e.g., peer-to-peer networks).

In some embodiments, the system is world-wide-web (www) based, and the network server is a web server delivering HTML, XML, etc., web pages to the computing devices. In other embodiments, a client-server architecture may be implemented, in which network server executes enterprise and custom software, exchanging data with custom client applications running on the computing device and the provider computing device.

The computing device and provider computing device may include conventional components such as one or more memory components and one or more processors. Examples of computing devices include such known mobile devices as smartphones, tablets, etc., but it should be understood that the computing device need not be a mobile device and the inventive concepts apply to other computing devices such as a desktop computer.

Processors 404 suitable for the execution of a computer program include both general and special purpose microprocessors and any one or more processors of any digital computing device. The processor will receive instructions and data from a read-only memory or a random-access memory or both. The essential elements of a computing device are a processor for performing actions in accordance with instructions and one or more memory devices for storing instructions and data. Generally, a computing device will also include, or be operatively coupled to receive data from or transfer data to, or both, one or more mass storage devices for storing data, e.g., magnetic, magneto-optical disks, or optical disks; however, a computing device need not have such devices. Moreover, a computing device can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive). Memory devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor 404 and the memory 406 can be supplemented by, or incorporated in, special purpose logic circuitry.

The memory module 406 may include a computer readable medium storing the application, which may include instructions. In an embodiment, the memory module 406 may contain different components for retrieving, presenting, changing, and saving data and may include computer-readable media. The memory module 406 may include a variety of memory devices, for example, Dynamic Random-Access Memory (DRAM), Static RAM (SRAM), flash memory, cache memory, and other memory devices. Additionally, for example, a memory module 406 and processors 404 may be distributed across several different computing devices that collectively comprise a system. The memory module 404 is capable of storing each user-generated information to be displayed on the computing device display.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

An equivalent substitution of two or more elements can be made for any one of the elements in the claims below or that a single element can be substituted for two or more elements in a claim. Although elements can be described above as acting in certain combinations and even initially claimed as such, it is to be expressly understood that one or more elements from a claimed combination can in some cases be excised from the combination and that the claimed combination can be directed to a subcombination or variation of a subcombination.

It will be appreciated by persons skilled in the art that the present embodiment is not limited to what has been particularly shown and described hereinabove. A variety of modifications and variations are possible in light of the above teachings without departing from the following claims.

What is claimed is:

1. A network-connected security system comprising:

an infrasonic detection system including a transducer to sense a plurality of infrasonic frequency variations in an environment and produce an output signal corresponding to the plurality of infrasonic frequency variations;

a processor adapted to compare, via an intrusion detection module in operable communication with the processor, the plurality of infrasonic frequency variations with a threshold value stored in a memory and determine if the threshold value is exceeded;

an alert module in operable communication with the processor, the alert module configured to transmit an output signal to an alarm system;

a controller located in the environment and in operable communication with the infrasonic detection system and a plurality of network-connected devices, the controller comprised of a user interface to determine control settings of the plurality of network-connected devices; and a computing device in operable communication with the controller providing remote control of the infrasonic detection system, the alarm system, and the plurality of network-connected devices via an application system displayed on a display of the computing device.

2. The system of claim 1, wherein the alarm system contacts one or more third-party users via a communications module.

3. The system of claim 1, wherein the plurality of network connected devices are comprised of: one or more thermostats, one or more occupancy sensors, one or more entryway devices, one or more hazard detection devices, one or more electrical components, one or more motion sensors, one or more cameras, and one or more speakers.

4. The system of claim 3, further comprising an event report generator configured to generate a report of an event, wherein the event is defined by at least one of the plurality of infrasonic frequency variations.

5. The system of claim 4, wherein the event report is comprised of one or more images received from the one or more cameras corresponding to the event.

6. The system of claim 1, further comprising an authentication module in operable communication with the processor, wherein the authentication module provides authorization to persons in the environment via security input signals received from the plurality of network-connected devices.

7. A network-connected security system comprising:

an infrasonic detection system including a transducer to sense a plurality of infrasonic frequency variations in an environment and produce an output signal corresponding to the plurality of infrasonic frequency variations;

a controller located in an environment and in operable communication with the infrasonic detection system and a plurality of network-connected devices, the controller comprised of a user interface to determine control settings of the plurality of network-connected devices;

a processor adapted to perform the following:

comparing, via an intrusion detection module in operable communication with the processor, the plurality of infrasonic frequency variations with a threshold value stored in a memory and determine if the threshold value is exceeded;

transmitting an output signal, the output signal transmitted to an alarm system via an alert module in operable communication with the processor, the alarm system configured to broadcast an alarm in response to the output signal;

determining, via the alert module, an alarm protocol in response to the output signal and executing the alarm protocol to produce the alert; and receiving, via a computing device, the alert.

8. The system of claim 7, wherein the alert is displayed on a display of the computing device as a report of an event, the report generated by an event report generator in operable communication with the processor.

9. The system of claim 8, wherein the event report is comprised of one or more images received from the one or more cameras corresponding to the event.

10. The system of claim 7, wherein the plurality of network connected devices are comprised of: one or more thermostats, one or more occupancy sensors, one or more entryway devices, one or more hazard detection devices, one or more electrical components, one or more motion sensors, one or more cameras, and one or more speakers.

11. The system of claim 10, further comprising a communication module in operable communication with the processor, wherein the communication module transmits an audio signal to the one or more speakers.

12. The system of claim 10, wherein the memory stores a plurality of third-party users contact information and a plurality of user contact information, wherein the communication module is in operable communication with the communication module and the alert module to transmit the alert to the plurality of third-party users and the plurality of users.

13. The system of claim 7, wherein the alert is comprised of a visual, an audible, or a tactile alert communicated to the environment, to the plurality of third-party users, to the plurality of users.

14. The system of claim 13, further comprising an authentication module in operable communication with the processor, wherein the authentication module provides authorization to persons in the environment via security input signals received from the plurality of network-connected devices.

15. A method for detecting an infrasonic frequency to analyze the security of an environment, the method comprising the steps of:

comparing, via an intrusion detection module in operable communication with a processor, a plurality of infrasonic frequency variations with a threshold value stored in a memory and determine if the threshold value is exceeded, the infrasonic frequency variations detected via an infrasonic detection system;

transmitting an output signal, the output signal transmitted to an alarm system via an alert module in operable communication with the processor, the alarm system configured to broadcast an alert in response to the output signal;

determining, via the alert module, an alarm protocol in response to the output signal and executing the alarm protocol to produce the alert; and receiving, via a computing device, the alert.

16. The method of claim 15, further comprising a controller located in an environment and in operable communication with the infrasonic detection system and a plurality of network-connected devices, the controller comprised of a user interface to determine control settings of the plurality of network-connected devices.

17. The method of claim 16, wherein the plurality of network connected devices are comprised of: one or more thermostats, one or more occupancy sensors, one or more entryway devices, one or more hazard detection devices, one or more electrical components, one or more motion sensors, one or more cameras, and one or more speakers.

18. The method of claim 17, further comprising a communication module in operable communication with the processor, wherein the communication module transmits an audio signal to the one or more speakers.

19. The method of claim 15, wherein the alert is displayed on a display of the computing device as a report of an event, the report generated by an event report generator in operable communication with the processor.

20. The system of claim 19, wherein the event report is comprised of one or more images received from the one or more cameras corresponding to the event.

* * * * *